United States Patent [19]

Mitchell

[11] Patent Number: 4,971,274

[45] Date of Patent: Nov. 20, 1990

[54] COMBINATION HOLDER FOR DISPOSABLE LEAF AND RUBBAGE BAGS AND YARD TOOL

[76] Inventor: Stephen A. Mitchell, 192 Adams Ave., West Newton, Mass. 02165

[21] Appl. No.: 411,874

[22] Filed: Sep. 25, 1989

[51] Int. Cl.[5] ..... B65B 67/04

[52] U.S. Cl. ..... 248/101

[58] Field of Search ..... 248/101, 95, 99, 100, 248/97; 220/1 T, 404; 141/391, 314

[56] References Cited

U.S. PATENT DOCUMENTS

| | | | |
|---|---|---|---|
| 2,789,781 | 4/1957 | Miller | 248/101 X |
| 3,916,962 | 11/1975 | Stolt | 248/101 X |
| 3,936,087 | 2/1976 | Alexander | 248/99 X |
| 4,312,531 | 1/1982 | Cross | 248/99 X |
| 4,445,658 | 5/1984 | Ferron | 248/100 X |
| 4,530,533 | 7/1985 | Dieter | 248/99 X |
| 4,548,372 | 10/1985 | Lutzker | 248/99 |
| 4,550,440 | 10/1985 | Rico | 220/404 X |
| 4,620,319 | 10/1986 | Sheehan et al. | 248/101 X |
| 4,775,123 | 10/1988 | Borland et al. | 248/99 |
| 4,815,866 | 3/1989 | Martone | 141/391 X |

*Primary Examiner*—David M. Purol

*Attorney, Agent, or Firm*—Herbert L. Gatewood

[57] ABSTRACT

Combination holder for maintaining mouth of plastic garbage or leaf bag in open position for storage of garbage for later disposal and garden tool for use in collecting leaves for disposal.

21 Claims, 4 Drawing Sheets

COMBINATION HOLDER FOR DISPOSABLE LEAF AND RUBBAGE BAGS AND YARD TOOL

BACKGROUND OF INVENTION a. Field of Invention

This invention relates to a combination holder for use in supporting and maintaining in open position plastic leaf and rubbage bags and to a garden tool. As a garden tool, it relates more particularly to a device useful in collecting leaves for storage and disposal.

b. Prior Art

Over the past several years, plastic bags have been commonly used for the disposal of trash and rubbage of various kinds, and for the collection and disposal of leaves and weeds. Nevertheless, their use for such purposes has not been without some difficulty due, in particular, to the flimsy nature of such bags. It is most difficult, in some cases at least, to get such bags open in the first place. Even after accomplishing such, it is even more difficult to maintain such open so as to be able to rake leaves into, or stuff other materials therein, e.g., rubbage, garbage, etc., for later disposal. Where such bags are used for collecting leaves, it is quite common to have one person holding the bag open, or at least trying to, while another rakes the leaves into it.

Heretofore others have disclosed holders for plastic bags for maintaining such bags open whereby to facilitate their use in the disposal of trash and litter, and the collection of leaves. Exemplary of such prior art are U.S. Pat. Nos. 3,916,962; 3,936,087; and 4,550,440.

In U.S. Pat. No. 3,916,962 there is disclosed a circular-shaped hoop for supporting the lip of a plastic bag in a fully opened condition. The bag opening support or hoop includes an attached scoop which facilitates movement of material towards and into the open mouth of the bag. The bag support, however, is without any means for supporting it on a wall or the like vertical surface. Neither can it readily serve as a bag for rubbage and garbage as it does not have a closure for inhibiting the transfer of odors therefrom when functioning as a garbage bag.

U.S. Pat. No. 3,936,087 discloses a collection receptacle for gathering leaves, twigs and the like into a plastic bag. The receptacle has an open cylindrical base and a scraper tray attached thereto. The plastic bag is located on the outside of the cylindrical base and its end at the mouth thereof is folded over and the folded over portion is frictionally engaged between the inside surface of the cylindrical base at its top edge and the scraper tray and handle in assembly with the base. The collection receptacle has no closure for its open top and would not be suitable for use as a receptacle for the collection and disposal of garbage. Neither does the receptacle have means whereby it could be detachably mounted on a wall or other vertical supporting member.

U.S. Pat. No. 4,550,440 discloses an article receptacle or bag holder which comprises two rectangular-shaped frames which nest together and between which can be frictionally engaged the open end of a plastic bag. The bag holder with bag maintained in open disposition can be detachably supported on a wall or the like by a mount permanently attached to the wall. The mount includes a pivotally mounted lid for closing over the bag's open end, preventing moisture or insects from entering into the bag and the escape of odors emanating from the bag. The bag can, if desired, be carried on one's belt for gathering litter while walking around one's yard or be laid on the ground. In the latter case, a scoop can be assembled with the assembled frames, and thus with the open mouth of the bag, to facilitate loading debris, e.g. by sweeping, directly from the ground into the bag. Although such article receptacle can function both for collection of garbage and for leaf collection, and has means for supporting it on a wall mount, as well as a cover for its open end, its construction is somewhat complex. Moreover, the scoop is a component separate and distinct from the frames. This necessitates not only the assembly therewith for use, but the need to carry along a separate item that may not be, in some cases, used at all. In any event, such construction requires a user to remember to take along the scoop when raking leaves, failing such he will have to return to the garage or other location to get it. Furthermore, it's a component that can be, it is believed, readily lost or inadvertently discarded.

SUMMARY OF THE INVENTION

It is a primary object of the present invention to provide a combination holder or assembly for detachably holding and supporting plastic bags in an open disposition.

A further object is to provide an assembly for detachably holding and supporting plastic bags and for maintaining the mouth thereof in open disposition which assembly can provide a dual use and function in the storage of garbage or collecting leaves, for later disposal, as desired.

A still further object is to provide an assembly of relatively simple construction for detachably holding plastic bags and maintaining the mouth thereof in open position.

An even further object is to provide an assembly for detachably holding a plastic bag and maintaining the mouth of such bag in open position suitable for use in collecting leaves.

A still further object is to provide an assembly for holding plastic bags in open position which includes a funnel-like attachment for use as an aid in raking a pile of leaves into the bag.

Another object is to provide a hangar means for hanging a box of leaf bags in combination with the bag holder.

Quite advantageously the combination bag holder of this invention is not only of relatively simple construction but its relatively light weight allows it to be readily carried around and used as a tool in collecting leaves for later disposal.

A further advantage is that the combination assembly disclosed herein provides easy means for raking leaves into a plastic leaf bag by one person working alone.

A still further advantage is that the combination holder's simple construction makes its manufacture relatively economical.

The objects and advantages of this invention are obtained, in general, by a combination assembly or holder which, because of its unique construction, is capable of providing a dual function. The combination assembly can be supported on and detachably connected to a wall or other vertically disposed surface and, in such a location, function to hold and maintain open the mouth of a plastic garbage or litter bag. The remainder of the bag is suspended in uninhibited fashion and extends downwardly toward and rests on the ground or other surface. Thus, the bag can be suspended, quite advantageously, in fully open position, allowing for unrestricted loading to the extent wanted. When desired, the assembly can be taken down from the wall and be used to hold and maintain open a plastic bag used to collect leaves that may have been already, or to be yet, raked up. That portion of the assembly that serves to support the assembly on the vertical surface when holding a garbage bag then functions as a funnel-like member for aid and use in raking leaves directly into the bag.

BRIEF DESCRIPTION OF DRAWINGS

The invention will, it is believed, be best understood by reference to the drawings in which.

DETAILED DESCRIPTION OF THE PREFERRED EMBODIMENTS OF THE INVENTION

Figure 1:
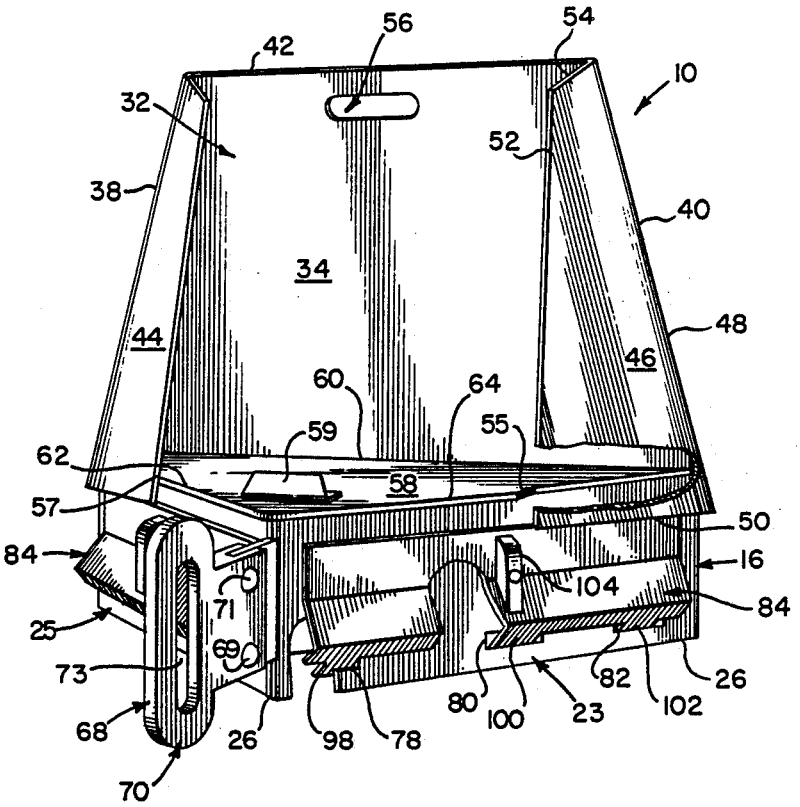
FIG. 1 is a view in perspective of an assembly or bag holder according to the invention, partially cut-away, to better show the back portion and shape of the detachable lid and to show how the bag gripping members are associated with the triangular-shaped body member of the bag holder.
Figure 5:
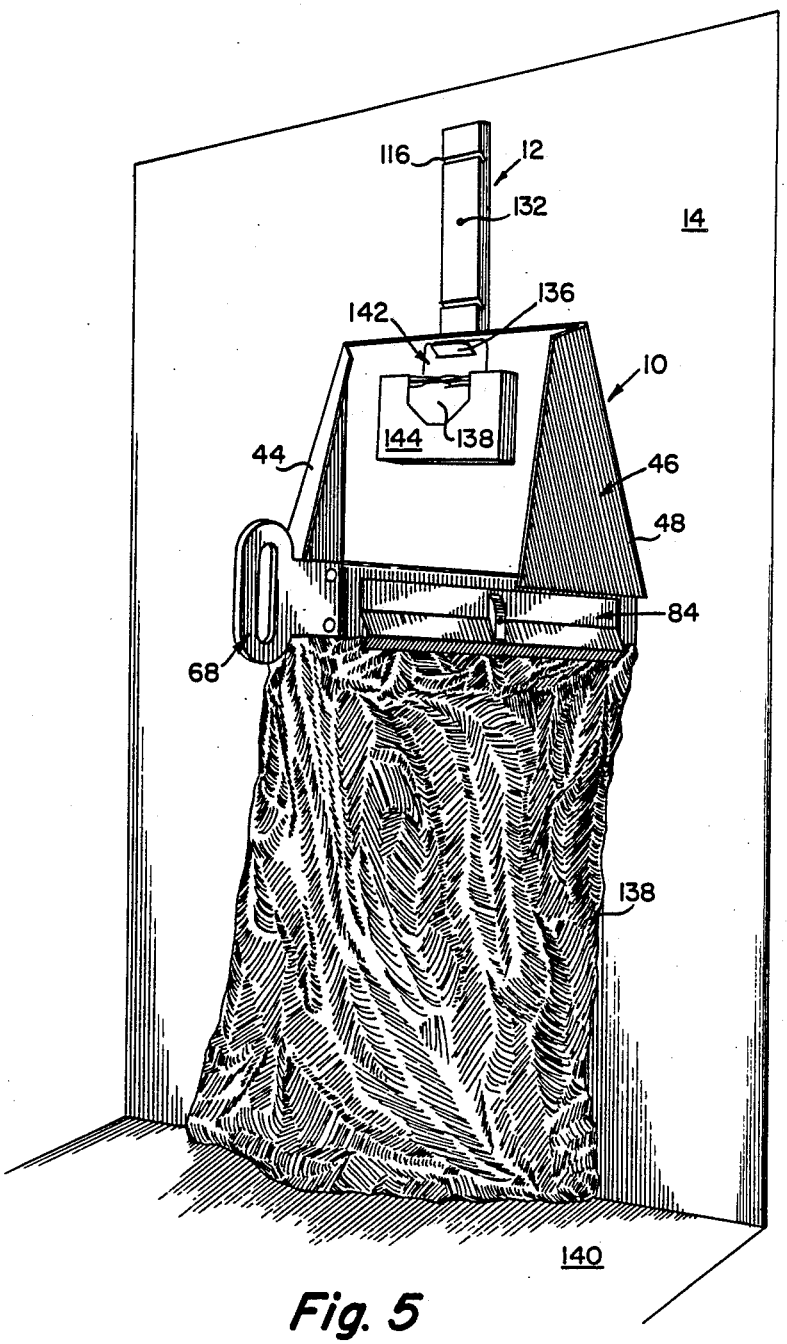
FIG. 5 is a view in perspective showing the assembly mounted on a vertically disposed supporting surface such as a garage wall, holding a plastic garbage or trash bag.

Referring now to the drawings, there is shown in FIG. 1 thereof a combination assembly 10 suitable for holding and supporting, in vertically suspended disposition, plastic leaf or trash bags, not shown in FIG. 1, in a fully open disposition. The assembly, or bag holder, 10 is to be detachably affixed on, and supported a suitable, predetermined vertical distance above the ground by, mounting means 12 which is directly fastened to a vertically disposed member such as an outside wall 14 of a garage (FIG. 5). Nevertheless, it should be appreciated that mounting means 12 can be fastened to any vertically disposed surface desired, e.g., the outside or inside planar wall of a garage or other building, an attached rear porch, etc. Or, the mounting means 12 can even be fastened to a post or other vertically disposed member especially provided in the yard at some desired location.

The assembly or plastic bag holder 10 comprises an elongated, vertically disposed body member 16 having an inside surface 18 and an outside surface 20 defined by vertically disposed planar side members 23, 25, and 27 (the rearwardly disposed side member). Each of the side members is of rectangular shape and is defined by a top and bottom edge 24, 26, and end edges 28, 30, an end edge of one side member being joined to an end edge of another side member. Thus, the elongated body member 16 defines a body member having a triangular-shaped cross section. As will be appreciated from the drawings, the side members are joined together such that their top edges 24 are in the same horizontal plane whereby to define a top edge of the elongated body member 16, and the bottom edges 26 of the side members terminate in the same horizontal plane, parallel to that defined by the top edges, defining a bottom edge of the elongated body member.

Attached to and extending vertically upwardly from side member 27 is a funnel-like attachment denoted generally by reference numeral 32. The funnel-like attachment or member 32 is defined by a vertically disposed planar bottom member 34 having an inner linear edge 36 which joins with the top edge of the elongated body member and spaced-apart side edges 38, 40 which taper inwardly towards one another at the same angle, each terminating in an outer linear edge 42, parallel to edge 36, and side walls 44, 46. The side wall 46, as shown by the drawing, extends outwardly from bottom member 34 and is defined by a bottom edge 48 which is joined to side edge 40 of the planar bottom member 34, an inner edge 50 joined to the body member 16 at or adjacent the top edge 24 thereof and a top edge 52 tapering downwardly from the inner edge 50 at its end opposite from bottom member 34 toward the said bottom member and its outer edge and terminates in outer edge 54. This outer edge then tapers outwardly somewhat and joins bottom member 34 at its outer edge 42, as will be seen by reference to FIG. 1. The side wall 44 is of similar construction, and, it is believed, need not be further described for an understanding of the invention.

The planar bottom member 34 is provided with an elongated, rectangular-shaped slot 56 located adjacent to outer edge 42 and disposed in the same direction. The corners of the rectangular-shaped slot 56, as shown, are rounded; however, this need not necessarily be the case, depending somewhat upon the particular manner of manufacture of the assembly. As will be readily appreciated, the purpose of such a slot is to enable the assembly 10 to be detachably mounted to, and be supported by mounting means 12 located on a vertically disposed wall 14 (FIG. 5) or the like supporting means. Such will be more fully disclosed, however, later on.

As shown in FIG. 1, a removable lid 58 is provided for use with the invention when such functions as a garbage receptacle. The lid 58 is, in general, of a triangular shape having a back edge 60 and side edges 62, 64. The side edges 62, 64 each comprises a front portion and a rear portion which are in parallel disposition to one another and are joined together by short linear edges 55, 57 perpendicular to back edge 60. The purpose for such, in this particular embodiment of the invention, is to allow lid 58 to clear the top edges of side members 44, 46 when raised. Nevertheless, it will be readily appreciated that side edges 62, 64 may be continuous where side members 44, 46 are of a lesser dimension at their inner edges so as to overlap the lid to a lesser extent. Lid 58 can be provided with a handle 59, if desired, making the removal or raising of the lid somewhat easier when placing litter or garbage into the bag, as later disclosed.

Connected to the elongated triangular-shaped body member 16 is a handle connecting member 66 which comprises a vertically disposed rectangular-shaped planar member 67 one vertical edge of which is integral with and connected to body connecting members 63, 65. The members 63, 65 diverge outwardly from one another at equal angles from the plane defined by vertically disposed member 67 which extends outwardly from the body member at the apex formed by side members 23, 25. The planar vertically disposed member 67 of handle connecting member 66 lies in a vertically disposed plane that bisects side member 27 of the elongated body member. The handle connecting member 66 can be attached to the side members 23, 25 by various conventional means, depending somewhat upon the materials of construction, e.g. rivets, threaded fasteners, adhesives. Also, connecting members 63, 65 need not be necessary in some cases, e.g. if body member 16 is of plastic, member 67 may be provided as an integral part of the body member during the molding process. Attached to handle connecting member 66 is a handle 68 defined by parallel planar sides having a hand gripping portion 70 having a slot 73 provided therein and a mounting portion 72 terminating in a vertically disposed end 74. Provided in end 74 is a vertically disposed rectangular-shaped slot 76 for location of the vertically disposed member 67 of the handle connecting member 66. The handle 68 can be joined to the handle connecting member by any conventional means desired providing for permanent fastening, e.g., screw fasteners 69, 71, as shown in the drawing which extend through the mounting portion 72 of the handle and the handle connecting member in conventional fashion, adhesive, rivets, etc. The manner of joining these two components together will depend somewhat upon the materials of construction.

Figure 2:
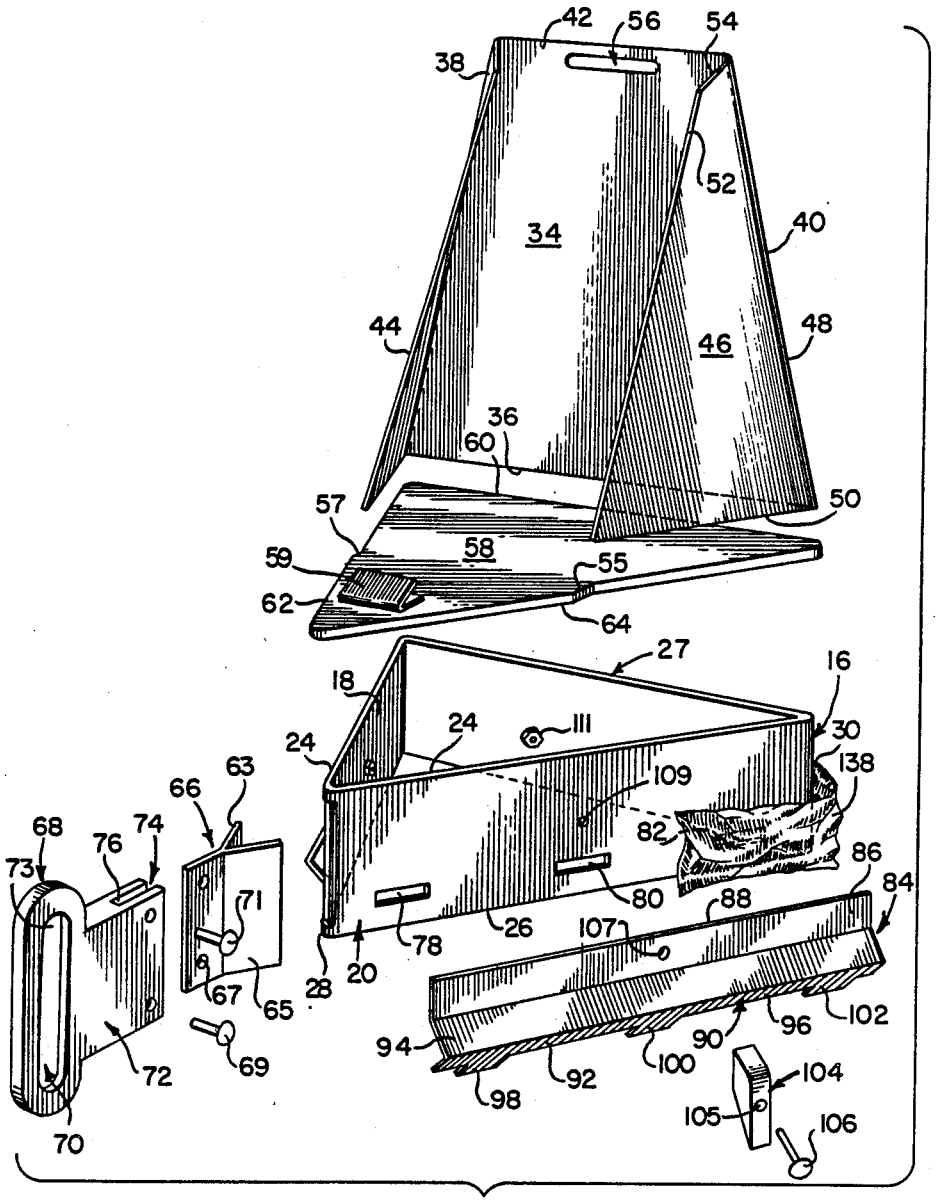
FIG. 2 is a view in perspective and in exploded disposition of the bag holder shown in FIG. 1 better showing the relationship of the various components of the assembly and how the bag gripping member is assembled with the side members.

The side members 23, 25, 27 are each provided with a plurality of elongated rectangular-shaped slots, as represented by reference numerals 78, 80, 82, in FIG. 2, in the case of side member 23. These slots are located in spaced-apart disposition, in the same horizontal plane, parallel to and adjacent the bottom edge 26 of side member 23. The slots provided in the other side members are similarly located so that all the slots in the side members lie in the same horizontal plane. The slots will preferably all be of the same dimension; however, the dimensions of the slots can be varied somewhat, as desired. In general, however, three slots, each measuring $\frac{5}{8}'' \times 3''$ will be provided in a side member which can be $7\frac{1}{4}'' \times 19\frac{1}{2}''$. The side members need not be of the same dimension. In the preferred practice of the invention, side members 23, 25 will be of equal dimension, and side member 27 (being an extension of the funnel-like member) will be somewhat longer, e.g., $7\frac{1}{4}'' \times 28''$.

In assembly with each of the side members (FIG. 2) is an elongated gripping means 84 having an elongated rectangular-shaped top portion 86 defining an inner planar surface 88 for engagement with the planar, outside surface of a respective side member, and an elongated planar bottom portion 90. The bottom portion 90 is of rectangular-shape and is defined by an inner edge 92 which is joined to one edge of an intermediate rectangular shaped portion 94 of the gripping means 84. The other edge of the intermediate portion 94 is joined to an edge of the elongated top portion 86. Thus, the bottom portion 90 and top portion 86 are provided in predetermined angle with respect to one another, the purpose for which will soon be made clear, if not already. Extending outwardly from the free outer edge 96 of the planar bottom portion 90, and in the same plane, are a plurality of rectangular-shaped teeth 98, 100, 102. The teeth are provided in spaced apart location along edge 96 and are of such a dimension, as to cooperate with, and intrude into elongated slots 78, 80, 82, when the gripping means 84 is assembled in operative engagement with side member 22. Although, in the preferred embodiment of this invention, as shown in the drawings, only three slots and teeth are disclosed, the invention is not so limited. Fewer or more cooperative slots/teeth may be found suitable in some cases. This will depend somewhat upon the dimensions of the side members and the slots/teeth themselves. Also, it will be appreciated that the slots need not necessarily be of rectangular shape. And, neither do the teeth. The slots may be of square configuration, or even of circular-shape, if desired. The teeth can also be rounded at their ends, if desired, to be less likely to penetrate the plastic bag, possibly starting a tear. The angle between the top portion 86 and intermediate portion 94 and between intermediate portion 94 and bottom portion 90 can be varied somewhat, depending on the respective widths of the intermediate and bottom portions. The only requirement is that these components of the gripping member be so angled with respect to one another that the teeth 98, 100, 102 properly intrude into respective openings 78, 80, 82 and that bottom portion 90 angles downwardly.

A gripping member 84 must be detachably connected to each of the side members, e.g., side member 23. Or, at the least, the gripping members 84 must be connected to the side members such that each such member can be displaced from a respective side member a suitable distance to allow disengagement of the teeth with the slots. Preferably, however, the two members can be completely disassembled from one another, providing greater ease in locating the open mouth of a plastic bag on the bag holder 10. A suitable means to accomplish this result is the assembly block 104 shown in FIG. 1. This block has an inside surface that is of a shape to conform to the shape of the outside surfaces of the top portion 86 and intermediate portion 94 of the gripping member 84. Thus, it has a top planar portion that presses against and is directly in contact with the outside surface of the top portion 86 of the gripping member. The bottom portion of the inside surface of assembly block 104 tapers outwardly toward the outer surface thereof and defines a planar surface at an angle that conforms to the outside surface of the middle portion 94. Thus, when a gripping member 84 is assembled with a side member, e.g. side member 23 and assembly block 104 is located in place, such action will cause the inside planar surface 88 of the top portion 86 of gripping means 84 to be in intimate contact with the outside surface of the side member. At the same time, the bottom tapered surface of the assembly block 104 will contact and push downwardly on the outside surface of intermediate portion 94. Thus, the assembly block 104 will prevent unintentional disengagement of the teeth on the gripping means 84 from the elongated slots in the side members of the elongated body member 10 whereby, as later disclosed, portions of the mouth of a plastic bag will be held intact until disassembly of the gripping means from the side members.

It will be appreciated that the assembly blocks 104 can be detachably connected to the side members in a number of different ways. The preferred, however, is by elongated screw fasteners which connect the three components together, i.e., assembly block, gripping means and side-wall member. Thus, a conventional elongated threaded fastener 106 having a head thereon can extend through an opening 105 provided in the assembly block 104, through an opening 107 provided in the top portion 86 of the gripping means and, hence through an opening 109 provided in the side member 23. The threaded fastener 106 after extending through opening 109 provided in the side member is capped by a wing nut 111 or the like.

Although only one assembly block 104 is shown in the drawings to be used in combination with a gripping member 84, two or more can be used, if desired. Nevertheless, quite satisfactory results will be achieved with one such member, centrally located between the ends of the side members, as shown. Where the side member is of a longer length such as side member 27, however, two assembly blocks 104 may be found more desirably used, to ensure that the teeth in the gripping member do not become disengaged, or even partially so, from their respective cooperating slots.

The assembly 10 and the various components making up each assembly, as disclosed above, can be manufactured of various materials of construction. The various components can be made of any conventional plastic materials commercially available, e.g. polyvinyl chloride, polystyrene, ABS resins, nylon, polyacetal, polypropylene, etc. The resin compositions can include the usual components, e.g. fillers, curatives, reinforcing agents, colorants, etc, as desired. The assembly or the various components comprising such can be formed by any of the conventional molding techniques. The body member 16 can be molded as an integral unit, or as parts and then assembled together. For example, the side members, and side walls of the funnel-like attachment can be molded individually and then joined together by suitable means, if desired. The joining in each case will depend somewhat upon the particular plastic used but may be, in some cases, by heat fusion or adhesive. Also, mechanical fasteners such as rivets and threaded fasteners can also be used.

If desired, the assembly 10 can be manufactured instead from wood or metal, or a combination of such materials with certain components being of plastic. Nevertheless, it is preferred that the assembly be of plastic, as this lends ease to the manufacturing process, and certain economies. Furthermore, it provides an assembly of light weight.

Figure 3:
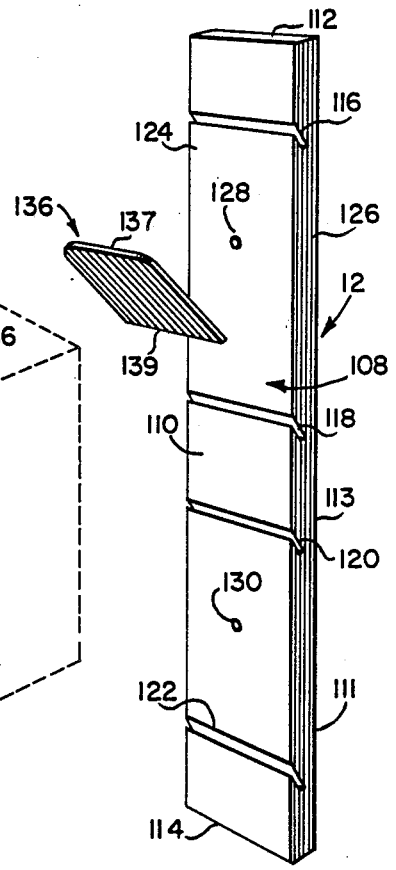
FIG. 3 is a perspective view of the mounting strip which is fastened to the wall shown in FIG. 5 for detachably holding the bag assembly shown in that figure of the drawing.

The mounting means 12, for mounting the assembly 10 on a vertically supporting surface such as disclosed in FIG. 5, will be better described by reference to FIG. 3. The mounting means 12 comprises an elongated rectangular shaped body member 108 defined by an outside planar surface 110 and an inside planar surface 111 parallel thereto, resting against and in contact with the vertically disposed planar mounting surface 14. Intermediate the ends 112, 114 of mounting means 12 there are provided a plurality of elongated slots or cuts 116, 118, 120, and 122, the purpose for which will soon be disclosed, if not already obvious. These slots, as shown, extend in length from one vertical edge 124 to the other vertical edge 126 and each slot is slanted downwardly toward the bottom end 114 and inwardly from the planar surface 110, terminating a predetermined distance short of the rear planar surface 111. Nevertheless, if desired, the length of the slots can be less than the width of the mounting means 12. Circular-shaped openings 128, 130, which extend entirely through the mounting means from the front face 110 and perpendicular thereto are provided in the mounting means for location of suitable fastening means 132, 134 (not shown) such as nails or screws. Extending outwardly from mounting means 12 and in an upwardly direction is a member 136 suitable for use as a hanger for the bag holder assembly 10, as will be seen by reference to FIG. 5. The member 136 is somewhat elongated and of planar configuration defined by a rectangular shape having an outer end 137 and an inner end 139. The inner end 140, as will be seen from FIG. 3, extends into the slot 118 and can, if desired, be secured therein, e.g. by adhesive. Nevertheless, preferably the hanger member 136 will be merely frictionally engaged by the surfaces of slot 118, allowing such member to be removed, if desired, and located in one of the other slots. For example, if it is desired to use a larger bag in the bag holder 10, it may be desirable to move the hanger member 136 to slot 116. It is desired that, when a bag is provided on the bag holder 10, such bag extend vertically downwardly to its full open disposition, i.e., the bottom thereof be merely resting on the ground or other supporting surface. Thus, the bag can be loaded to the fullest extent without any restrictions, yet the weight of the contents will be primarily supported by the ground. This being the case, there will be less tendency for a tear to develop in the bag at its mouth end where gripped and held open.

Turning now to FIG. 5, a plastic bag 138 is shown being held in open disposition by the combination assembly 10 of the invention. Thus, the mouth of the bag is seen (FIG. 2) to be located on and surrounds the outside surface of the elongated body member 16 adjacent the bottom edge thereof, as shown. A number of spaced-apart portions of the mouth of the bag 138, as will be appreciated by reference to FIG. 2 of the drawing, are trapped by the teeth on the gripping means as such are in operative assembly with respective side members. These bag portions intrude into the associated openings in the side members and are held therein by the teeth. As seen in FIG. 5, the plastic bag 138 extends downwardly to its maximum extent, the bottom resting on the ground indicated by reference numeral 140.

The installation of plastic bag 138 onto the bag holder 10 can be readily accomplished. This is done, in general, by placing the assembly 10 on the ground with the handle 68 between one's legs and the funnel-like attachment extending downwardly, resting on the ground or other supporting surface. The side member 27, opposite the handle can be, if desired, rested temporarily against a vertically disposed supporting surface. A plastic bag 138 is then opened and the mouth thereof is then placed around the bottom edges of the side members and around all three corners of the triangular-shaped body member so as to be on the outside surface of the body member. The mouth of the bag should overlap the bottom edge a few inches at least (FIG. 2) so as to be above the elongated slots in the side members. Naturally, the gripping members 84 will have been previously disassembled from each of the associated side members, or at least the blocks 104 will have been loosened enough to allow disengagement of the tooth members from the respective slots associated therewith, to allow the mouth of the plastic bag to be pushed down sufficiently over the bottom edge of the body member and evenly toward the top edges 24 thereof. At this point, the plastic bag is turned inside out and the excess thereof is pushed downwardly into the inside of the body member, to be out of the way. The mouth of the bag is then adjusted, if necessary, pulling it downwardly so that it is evenly beyond the elongated slots or cut-outs in the side members. The gripping members are each then, if completely detached, assembled with respective side members and are somewhat loosely fastened thereto by tightening down on the threaded fastening means 106 located in the blocks. The teeth on the gripping members are then engaged with respective slots, at the same time pushing into the slot a portion of the plastic bag adjacent the mouth opening, and the assembly blocks 104 are then securely tightened down. Importantly, each of the teeth will have trapped a portion of the bag when intruding into its associated slot, and will have pushed that portion into the slot with it. As the teeth slant downwardly, the trapped portions of the bag are securely held within the slots and prevented from slipping off the teeth. Next, the gathered, excess bottom portion of the bag will be pulled out of the center of the bag holder, at the same time causing it to turn inside-out. The bag holder 10, with the attached bag 138 held thereon, is then ready for use, either for deposit of garbage or trash therein, or as a garden tool in the collection of leaves.

The use of the invention for holding garbage bags for temporary storage of garbage is shown in FIG. 5. When garbage or other litter is to be stored in the plastic bag 138, the lid 58 is raised and the garbage or litter introduced therein. Generally, this litter, etc. will itself be in a bag such as a grocery bag or the like. Nevertheless, litter, etc. can be placed directly in bag 138, if desired. As bag 138 becomes full, its contents can, if desired, be compacted somewhat according to usual techniques for compacting such containers. When the bag is suitably full, the bag holder 10 is preferably disconnected from the mounting assembly 12, to remove the strain on the bag 138, making its removal from the bag holder 10 assembly somewhat easier. Then, the assembly blocks 104 are each loosened, allowing the gripping members 84 to be disengaged from the respective side members 23, 25, 27 and the teeth in the gripping members to be freed from the associated openings. The plastic bag portions, if not freed from the teeth during such disengaging actions, can then be freed from the teeth by hand. The assembly 10 is then ready for placement of an empty bag 138 thereon, as earlier disclosed. The mouth of the full bag is closed and then made secure by a conventional plastic bag, or other, tie means.

Figure 4:
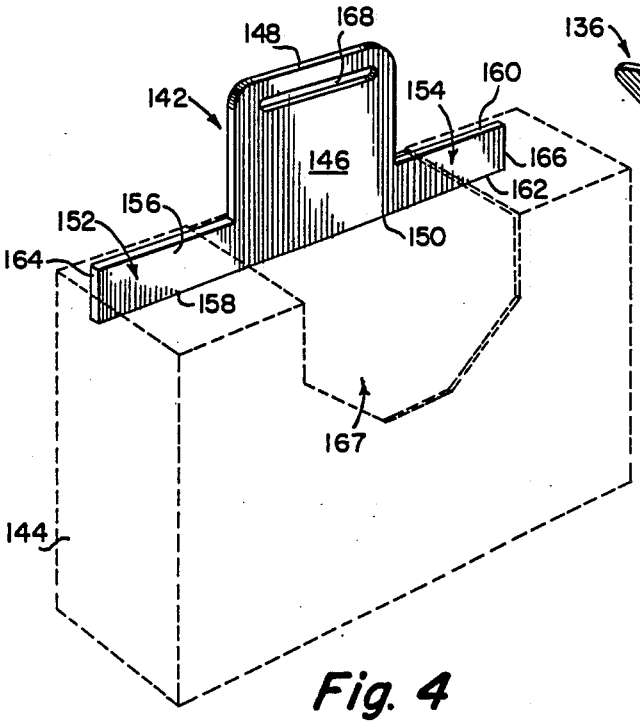
FIG. 4 is a perspective view of a hanger used for detachably holding a box of plastic lawn or garbage bags on the mounting strip, along with the plastic bag holder, as shown in FIG. 5.

Quite advantageously, in a related aspect of the invention, an empty plastic bag 138 can be made readily available for installation, on removal of a full one. Thus, as shown in FIG. 4, there is provided a box hanger 142 for holding a conventional box 144 (FIG. 5) of plastic leaf or garbage bags 138, in folded up disposition. The box hanger 142 comprises a planar body member 146 of rectangular shape having a top linear edge 148 and a bottom edge 150 parallel to the top edge. Extending outwardly from the body member 146, and in opposition to one another, are outwardly extending arms 152, 154 having a rectangular shape and defined by top and bottom edges 156, 158 and 160, 162, and end edges 164, 166, respectively. The arms 152, 154 are each of planar configuration and lie in the same plane defined by body member 146. Adjacent top edge 148, there is provided an elongated slot 168 of rectangular configuration and in parallel disposition to the top edge 148. The elongated slot 168 will need be long enough and of sufficient width to accommodate the planar hanger member 136 located on mounting means 12. As will be readily appreciated, the box hanger 142, will be provided in an opened conventional box 144 of plastic bags. These boxes, in general, will be about 10″ in length and have a perforated tear-out portion which, as shown in FIG. 4, when torn out, will leave an opening 167 on the top of the box about 6–8 inches long. Thus, the length of the box hanger from end 164 to 166 should be on the order of about 8–9 inches. The main thing is that the arms 152, 154 each overlap the box opening on the top thereof about an inch, to provide a suitable bearing surface. If desired, the arms 152, 154 can be wider, particularly at their top edges, than the thickness of the planar body member 146. Nevertheless, this need not be for the practice of this invention. Thus, when a new box of plastic bags is provided, the perforated tear-out portion will be removed and the box hanger 142 inserted therein. The box hanger 142 will then be located on the mounting means 12 by hanging it on the hanger member 136. Accordingly, when a new plastic bag is needed, it is always at hand and readily available for mounting on the bag holder 10.

Figure 6:
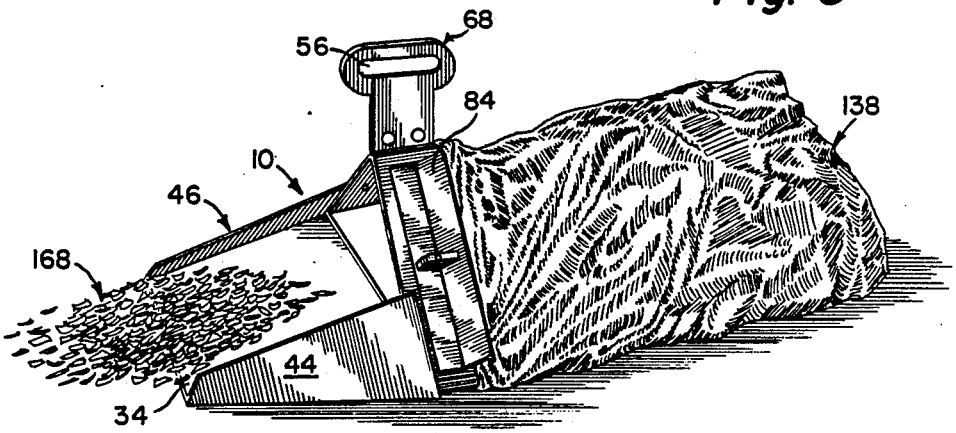
FIG. 6 is a view in perspective showing the use of the assembly of the invention as a garden tool or aid useful in raking leaves directing into a plastic leaf bag for later disposal.

The use of the assembly 10 of the invention as a garden tool, in the collection of leaves, is shown in FIG. 6. As disclosed therein, the assembly 10 is placed on the ground with the back side of the planar bottom member 34 of funnel-like attachment 32 being located directly on the ground near where leaves 168 are to be raked up into a pile, or to be raked directly into the leaf bag 138. The leaves 168, as shown in the drawing, are directed by the funnel-like attachment into the open mouth of the leaf bag. Periodically, as the leaf bag is filled, the leaves therein can be compacted so as to get more leaves into the bag. This can be readily accomplished by taking hold of handle 68 and the outer end of the bottom member 34, at slot 56, (which portion can serve as a second handle, in this case) and raising the leaf bag 138 to a vertical disposition. Any leaves in the funnel-like attachment 32 and within the body member 16 will, on shaking of the assembly in an up and down manner, drop down into the bag. Then the assembly bottom edge 26 can be used to compact the leaves in the bag by pushing down hard a couple of time against the leaves. If desired, the assembly 10 can be moved from one pile of leaves to another. This can be readily accomplished by taking hold of handle 68 and carrying the assembly 10 along with a partially filled bag of leaves to the next collection point. The light weight of the assembly makes it most suitable for transport in this manner.

Although the invention has been particularly disclosed as having a triangular shaped cross-section, it will be appreciated that such shape is not absolutely necessary. The important consideration is that the body member of the assembly have at least one planar side member and that the bottom member of the funnel-like attachment also be planar, and that such be located in the same plane as that of the said planar side member. Thus, the assembly will best function in the dual purposes set forth herein. Otherwise, the side members, e.g. side members 23, 25, can be curved, i.e., concave, rather than planar, in which case the gripping members associated therewith will also need be curved, and conform to the shape of the side members. The two outwardly extending side members can even be replaced, if desired a by one curved member, the ends of which will be attached to the ends of the planar side member, i.e. side member 27, as above disclosed in the case of the preferred triangular-shaped body member. Also, if desired, the lid 58 may be provided not only with a handle to provide greater ease in its being raised or removed from the assembly, but with one that fastens, better preventing accidental removal or removal by animals such as raccoons. The lid 58, quite advantageously, however, is not attached to the body member 16, so that the assembly can be more readily used, as desired for collection of leaves.

Further, the assembly has other uses than particularly disclosed above. With the plastic bag attached, it can readily function as a clothes hamper. Of advantage also, when compared to prior leaf bag holders of which I am aware, the assembly of this invention with its other possible uses, particularly as a garbage bag holder, can be used year round.

The foregoing detailed description has been given for clearness of understanding only and no unnecessary limitations are to be understood therefrom. The invention is not limited to the exact details shown and described for obvious modifications and variations will now occur to those skilled in the art without departing from the spirit and scope of the invention as described in the following claims.

What I claim is:

1. Combination assembly suitable for use in detachably holding plastic leaf and rubbage bags and the mouth thereof in open disposition comprising an elongated vertically disposed body member having an inside surface and outside surface defined by at least one vertically disposed planar side member, said body member having an open top defining a horizontally disposed top edge located in a plane perpendicular to the plane of the said vertically disposed planar side member and an open bottom defining a horizontally disposed bottom edge parallel to the said top edge, a funnel-like attachment fixedly connected to the planar side member of the body member at the top edge, said funnel-like attachment being defined by a vertically disposed planar bottom member lying in the same vertical plane as the said planar side member and being defined by an inner linear edge terminating at the said top edge of the said elongated body member, an outer edge, and spaced-apart side edges which taper inwardly toward one another from said inner linear edge at the same angle and terminating at the said outer edge, and side walls spaced apart from one another and extending outwardly from said planar bottom member, each said side wall being defined by a bottom edge connected to respective tapered side edges of the said bottom member, an inner edge connected to, and adjacent to the said top edge of, the elongated body member and a top edge tapering downwardly from said inner edge toward said bottom member and terminating at an outer edge which connects to the outer edge of the said bottom member, and means detachably connected to the said body member on at least one of its said inside and outside surfaces for gripping and holding the open top rim portion of a leaf or rubbage bag.

2. Combination assembly according to claim 1 wherein the said vertically disposed elongated body member of the assembly is defined by three vertically disposed planar side members each said side member being defined by vertically disposed spaced-apart end edges parallel to one another, said side members being joined one to the other at their end edges whereby to define an elongated body member having a triangular shaped cross-section.

3. Combination assembly according to claim 2 wherein the said vertically disposed planar side members are each of rectangular shape.

4. Combination assembly according to claim 3 wherein the rectangular-shaped side members are all of the same dimension.

5. Combination assembly according to claim 4 wherein the said outer edge of the bottom member of the funnel-like attachment is linear and parallel to the said inner edge.

6. Combination assembly according to claim 5 wherein an elongated slot is provided in said bottom member adjacent to said outer edge and parallel thereto whereby said assembly can be detachably mounted to, and be supported by, mounting means in vertically disposed fashion so that the garbage bag will extend vertically downwardly therefrom in open disposition.

7. Combination assembly according to claim 6 further compromising in combination therewith a mounting means for detachably supporting the said assembly in vertically disposed fashion, said mounting means comprising an elongated body member defined by an outside planar surface and being adapted for mounting on a support surface in vertically disposed fashion, a plurality of parallel, horizontally disposed, elongated cuts being provided in said planar surface in predetermined spaced apart locations, each extending inwardly from said planar surface and downwardly a predetermined distance, at least one hanger member having an inner end conforming to and extending into one of said elongated cuts, said hanger member protruding outwardly and vertically upwardly from said body member whereby said combination assembly can be supported by said mounting means by locating the said assembly relative to the mounting means so that the hangar member intrudes into the said elongated slot provided in the funnel-like attachment.

8. Combination assembly according to claim 2 wherein handle means is provided on said body member for ease in use of the said assembly in collection of leaves.

9. Combination assembly according to claim 8 wherein a vertically disposed planar member extends outwardly from the joined end edges of two said side members and lies in a plane bisecting the plane defined by the third side member and said handle means comprises a vertically disposed elongated member having an inner edge and being connected at said inner edge to said vertically disposed planar member.

10. Combination assembly according to claim 2 where said gripping means for the plastic bag is provided on the outside surface of the said body member and comprises means in combination with said body member for engaging a portion of the plastic bag adjacent the open mouth thereof.

11. Combination assembly according to claim 10 wherein said gripping means comprises an elongated member for detachable engagement with each of said side members, each said elongated member having an elongated top portion having an inside surface defining a planar surface for engagement with the outside surface of a side member.

12. Combination assembly according to claim 10 wherein a plurality of openings is provided in each said vertically disposed side member adjacent the said bottom edge of the said body member, and each said elongated member has a bottom portion defining a plurality of tooth-like members extending outwardly from said elongated member and intruding into said plurality of openings in the associated side member when said side member and elongated member are in operative engagement with one another, whereby a plurality of portions of said plastic bag will be gripped by and between each of said plurality of openings and intruding tooth-like members.

13. Combination assembly according to claim 1 wherein said assembly further comprises a detachable cover for the said open top of the elongated body member, said cover being defined by planar top and bottom surfaces and a perimeter overlying said top edge and conforming to the shape of the open top of the said body member.

14. Hanger for detachably holding a box of plastic leaf and lawn bags or the like having a rectangular-shaped planar top surface defining a rectangular-shaped opening therein and having a planar inner surface, said hanger comprising a body member having a horizontally disposed bottom edge and a pair of elongated members each of predetermined length defined by a top and bottom edge extending outwardly from said body member adjacent said horizontally disposed bottom edge and in opposite directions from one another, said hanger in use being capable of being inserted in said opening and extending in lengthwise direction of the said top surface whereby the inner surface of the box contacts the said elongated members and the box can be supported in a predetermined disposition.

15. Hangar according to claim 14 wherein said body member is planar and is further defined by a top edge and said elongated members are planar and in the same plane defined by the planar body member, and an elongated, horizontally disposed opening is provided in said body member adjacent said top edge for intrusion of an outwardly extending planar member on an elongated mounting strip for holding the hanger in predetermined vertical disposition.

16. Kit for providing an assembly for holding plastic bags and for maintaining the mouth of such bags in open disposition suitable for use in holding and storing garbage and litter and also in the collection of leaves comprising:

(1) an elongated body member defined by three vertically disposed planar side members interconnected together end-to-end and defining a body member having a triangular-shaped cross-section, a funnel-like attachment having a planar bottom member connected to and extending from one of said side members in the same plane;

(2) gripping means for association with each of said side members for gripping of the open mouth of a plastic bag;

(3) means for detachably mounting said assembly on a vertically disposed support member; and (4) means for conveniently and detachably hanging a box of plastic bags on said mounting means.

17. Combination assembly suitable for use in detachably holding plastic leaf and rubbage bags and the mouth thereof in open disposition comprising an elongated vertically disposed body member having an inside surface and outside surface and being defined by three vertically disposed planar side members, each said side member being defined by vertically disposed spaced-apart end edges parallel to one another, said side members being joined one to the other at their end edges whereby to define an elongated body member having a triangular shaped cross-section, said body member having an open top defining a horizontally disposed top edge located in a plane perpendicular to the plane of the said vertically disposed planar side members and an open bottom defining a horizontally disposed bottom edge parallel to the said top edge, a funnel-like attachment fixedly connected to one of the planar side members of the body member at the top edge, said funnel-like attachment being defined by a vertically disposed planar bottom member lying in the same vertical plane as the said one planar side member and being defined by an inner linear edge terminating at the said top edge of the said elongated body member, an outer edge, and spaced-apart side edges which taper inwardly toward one another from said inner linear edge at the same angle and terminating at the said outer edge, and side walls spaced apart from one another and extending outwardly from said planar bottom member, each said side wall being defined by a bottom edge connected to respective tapered side edges of the said bottom member, an inner edge connected to, and adjacent to the said top edge of, the elongated body member and a top edge tapering downwardly from said inner edge toward said bottom member and terminating at an outer edge which connects to the outer edge of the said bottom member, a vertically disposed planar member extending outwardly from the joined edges of two said side members and lying in a plane bisecting the plane defined by the third side member, handle means comprising a vertically disposed elongated member having an inner edge and being connected at said inner edge to said vertically disposed planar member for ease in use of the said assembly in collection of leaves, and means detachably connected to the said body member on at least one of its said inside and outside surfaces for gripping and holding the open top rim portion of a leaf or rubbage bag.

18. Combination assembly according to claim 17 wherein a vertically disposed elongated slot is provided in said handle means for ease in gripping with one's hand and fingers.

19. Combination assembly suitable for use in detachably holding plastic leaf and rubbage bags and the mouth thereof in open disposition comprising an elongated vertically disposed body member having an inside surface and outside surface and being defined by three vertically disposed planar side members, each said side member being defined by vertically disposed spaced-apart end edges parallel to one another, said side members being joined one to the other at their end edges whereby to define an elongated body member having a triangular shaped cross-section, said body member having an open top defining a horizontally disposed top edge located in a plane perpendicular to the plane of the said vertically disposed planar side members and an open bottom defining a horizontally disposed bottom edge parallel to the said top edge, a funnel-like attachment fixedly connected to one of the planar side members of the body member at the top edge, said funnel-like attachment being defined by a vertically disposed planar bottom member lying in the same vertical plane as the said one planar side member and being defined by an inner linear edge terminating at the said top edge of the said elongated body member, an outer edge, and spaced-apart side edges which taper inwardly toward one another from said inner linear edge at the same angle and terminating at the said outer edge, and side walls spaced apart from one another and extending outwardly from said planar bottom member, each said side wall being defined by a bottom edge connected to respective tapered side edges of the said bottom member, an inner edge connected to, and adjacent to the said top edge of, the elongated body member and a top edge tapering downwardly from said inner edge toward said bottom member and terminating at an outer edge which connects to the outer edge of the said bottom member, a vertically disposed planar member extending outwardly from the joined edges of two said side members and lying in a plane bisecting the plane defined by the third side member, handle means comprising a vertically disposed elongated member having an inner edge and being connected at said inner edge to said vertically disposed planar member for ease in use of the said assembly in collection of leaves, and means detachably connected to the said body member for gripping and holding the open top rim portion of a leaf or rubbage bag which comprises an elongated member for detachable engagement with each of said side members, each said elongated member having an elongated top portion having an inside surface defining a planar surface for engagement with the outside surface of a side member, and a bottom portion defining a plurality of tooth-like members, a plurality of openings being provided in each said vertically disposed side member adjacent the said bottom edge of the said body member, said plurality of tooth-like members each extending outwardly from said elongated member and intruding into respective said plurality of openings in an associated side member when said side member and elongated member are in operative engagement with one another, whereby a plurality of portions of said plastic bag will be gripped by and between each of said plurality of openings and intruding tooth-like members.

20. Combination assembly suitable for use in detachably holding plastic leaf and rubbage bags and the mouth thereof in open disposition comprising an elongated vertically disposed body member having an inside surface and outside surface and being defined by three vertically disposed planar side members, each said side member being defined by vertically disposed spaced-apart end edges parallel to one another, said side members being joined one to the other at their end edges whereby to define an elongated body member having a triangular shaped cross-section, said body member having an open top defining a horizontally disposed top edge located in a plane perpendicular to the plane of the said vertically disposed planar side members and an open bottom defining a horizontally disposed bottom edge parallel to the said top edge, a funnel-like attachment fixedly connected to one of the planar side members, and means detachably connected to the said body member on at least one of its said inside and outside surfaces for gripping and holding the open top rim portion of a leaf or rubbage bag.

21. A mounting means for detachably mounting and supporting a plastic bag holding assembly in vertically disposed manner, said holding assembly comprising a funnel-like attachment defined by a planar bottom member having an outer linear edge and an elongated slot provided adjacent thereof, said mounting means comprising an elongated, rectangular-shaped body member defined by an outer planar surface, a plurality of spaced-apart, parallel, elongated openings being provided in said planar surface each extending inwardly therefrom and vertically downwardly a predetermined distance, and a member having an inner end conforming in size and shape to said elongated openings, said member when in operative engagement with one of said openings extending outwardly and vertically upwardly from said body member whereby to provide a hanger for the said assembly when said hanger is engaged in the slot on the funnel-like attachment, said plurality of openings providing means for locating said hanger in use at different vertical heights for the most desired vertical location of the combination assembly.

* * * * *